United States Patent [19]

Thrasher et al.

[11] Patent Number: 4,941,452

[45] Date of Patent: Jul. 17, 1990

[54] PULSE COMBUSTION SPACE HEATER

[75] Inventors: William H Thrasher, North Royalton; Charles M. Pavlik, Cleveland, both of Ohio; Larry Moon, Russellville, Ala.

[73] Assignee: Gas Research Institute, Chicago, Ill.

[21] Appl. No.: 396,741

[22] Filed: Aug. 18, 1989

Related U.S. Application Data

[63] Continuation of Ser. No. 320,419, Mar. 8, 1989, abandoned.

[51] Int. Cl.[5] ..... F24H 3/02

[52] U.S. Cl. ..... 126/110 R; 126/116 R; 126/99 R; 431/1

[58] Field of Search ..... 126/99 R, 110 R, 116 A, 126/116 R, 112, 117; 431/1, 18; 122/24; 60/247, 39.76, 39.77

[56] References Cited

U.S. PATENT DOCUMENTS

| | | | |
|---|---|---|---|
| 4,164,210 | 8/1979 | Hollowell | 126/110 R |
| 4,309,977 | 1/1982 | Kitchen | 126/116 A |
| 4,568,264 | 2/1986 | Mullen | 431/1 |
| 4,601,654 | 7/1986 | Kitchen | 431/1 |
| 4,651,712 | 3/1987 | Davis | 116/110 R |

OTHER PUBLICATIONS

"Development of a Pulse Combustion Heater", R. A. Borgeson and W. H. Thrasher, GRI Report No. GRI-87-0142, Apr. 1987.

*Primary Examiner*—James C. Yeung

*Attorney, Agent, or Firm*—Pearne, Gordon, McCoy & Granger

[57] ABSTRACT

A pulse combustion fired space heater is disclosed. The heater has an exterior cabinet enclosing an interior housing having a pulse combustion burner mounted therein. The burner includes a plurality of generally flat elements which cooperate with the interior housing to provide a tortuous path for air circulated through the chamber during heat transfer. The circulating air pressurizes the interior housing to enhance uniformity of heat transfer and suppress structural vibrations.

10 Claims, 2 Drawing Sheets

PULSE COMBUSTION SPACE HEATER

This is a continuation of application Ser. No. 320,419, filed on Mar. 8, 1989, abandoned.

BACKGROUND OF THE INVENTION AND PRIOR ART

This invention relates to combustion heaters and, in particular, to gas fired pulse combustion space heaters.

The development of suitable pulse combustion furnaces has enabled the advantages and efficiencies of pulse combustion to be attained in residential central heating. In addition to the advantages of self-sustaining operation, the steady state thermal efficiency of such central heating systems may be higher than 90% and provide significant operating cost savings. There is a need for a pulse combustion fired space heater to provide comparable advantages and thermal efficiencies.

The development of a suitable space heater involves restrictive size and noise suppression requirements since space heaters are not typically isolated in a basement or closet as in the case of a central heating furnace. For a heater capacity of about 20,000 BTU/hr. to be used in residential applications, the compact size requirements of commercially sized space heaters require that the overall size of the appliance be about 3 feet wide, 2 feet high and 1 foot deep. The sound level of the unit at a distance of three feet should be about 53 dBA or less.

The imposition of size requirements, especially the relatively compact dimensions contemplated herein, are particularly difficult to meet in pulse combustion systems since the resonant operation thereof requires certain geometric configurations and/or size relationships to be observed. More particularly, in pulse combustion burners of the Helmholtz type, an oscillating or pulsed flow of combustion gases through the burner is maintained at a frequency determined by burner component geometry and fuel supply characteristics. Typically, a combustion chamber of a given size cooperates with a tailpipe or exhaust pipe of specific dimensions to provide explosive combustion cycles, thermal expansion of the combustion gases, and oscillating gas pressures which provide a pulsed flow of combustion gases through the burner. In order to make the pulse combustion process self-sustaining, the oscillating gas pressures may be used to provide self-feeding of a combustible gaseous mixture. Accordingly, the close relationship between pulse combustion operation and heater geometry restricts variation in the spatial arrangement and compaction of the heater elements to meet commercial size requirements. It is also necessary to achieve efficient heat transfer with the air to be conditioned.

SUMMARY OF THE INVENTION

In accordance with the present invention, an improved pulse combustion space heater is provided having desired compactness of size and quietness of operation. A multilayer stacked arrangement of pulse burner elements within a heat transfer chamber provides compactness of size and presents an obstructed flow path for a circulating flow of air to be temperature conditioned during countercurrent heat transfer with the burner elements.

The heat transfer chamber is provided by an interior housing arranged to cooperate with the burner elements to define the flow path for the air flow through the heater. The heat transfer chamber has a volume selected in accordance with the size of the burner elements to transfer a significant proportion of the combustion heat to the circulating air with substantial elimination of localized sites of significantly different temperature. The chamber volume, size of the burner elements and rate of the air flow also cooperate to sufficiently pressurize the housing to inhibit mechanical vibration and associated sound transmission. Accordingly, the material used to construct the housing may be of relatively thin gauge and the need for vibration reducing members such as stiffening elements is substantially avoided.

In the illustrative embodiment of the space heater, the air to be conditioned is passed in countercurrent heat transfer with the burner elements by sequentially contacting elements of increasing operating temperature. Countercurrent heat transfer enables the combustion gases to be cooled to their dew point or condensing temperature and the coolest or most downstream heater element to operate as a condenser.

The thermal steady state efficiency of the space heater is in the range of 90%. Accordingly, the pulse combustion space heater provides a directly vented heater appliance having an efficiency approaching that of an unvented heater without the disadvantages of discharging the combustion products into the conditioned air space. The self-feeding characteristics of pulse combustion also facilitate the use of outdoor air for purposes of combustion. In comparison with the use of indoor air, the outdoor air tends to have a lower content of chlorides which are particularly associated with the corrosion of metallic combustion apparatus.

DETAILED DESCRIPTION OF THE DRAWINGS

Figure 1:
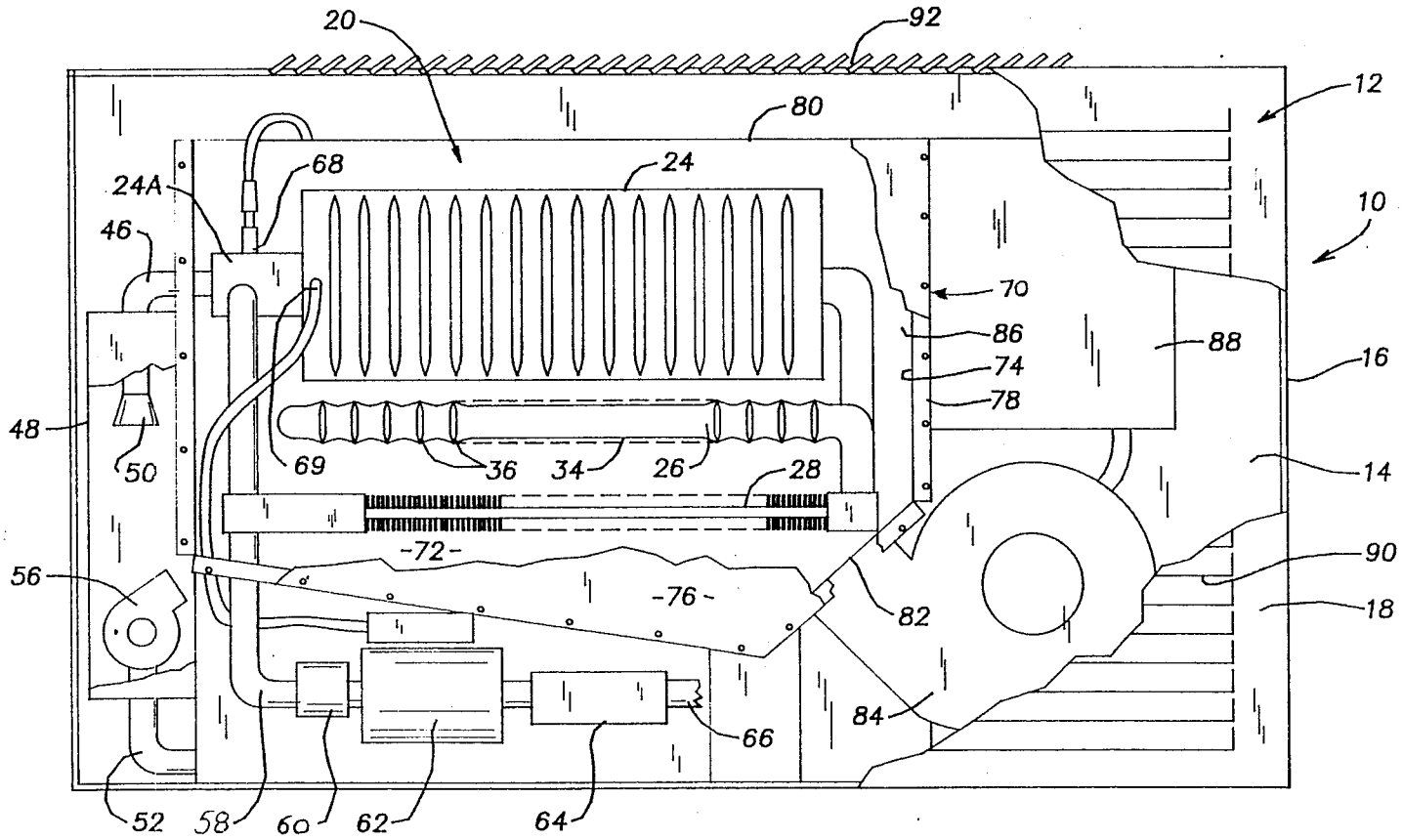
FIG. 1 is a somewhat schematic front elevational view of a space heater including a pulse combustion burner in accordance with the invention.

Referring to FIG. 1, a space heater 10 is shown. The heater 10 is a direct vent heater wherein the combustion system is sealed from the conditioned space. Accordingly, combustion air is obtained from the outdoors and exhaust or combustion product gases are vented to the atmosphere. The heater 10 is of the wall mounted type, but may be constructed as a free standing unit. The heater 10 is designed to operate at a fuel input rate of 20,000 BTU/hr.

The heater 10 includes a cabinet 12 having a rear wall 14 adapted to be mounted to an exterior room wall, a peripheral wall 16, and a demountable front wall 18. The cabinet 12 is 39" wide, 23½" high and 10" deep.

A pulse combustion burner or heater 20 is mounted within the cabinet 12. The major components of the burner 20 are arranged in a burner element assembly 22 including a combustion chamber 24, a tailpipe or exhaust pipe 26 and a secondary or condensing heat exchanger 28. A mixer head **24*a* is integrally formed with the combustion chamber 24**.

Figure 2:
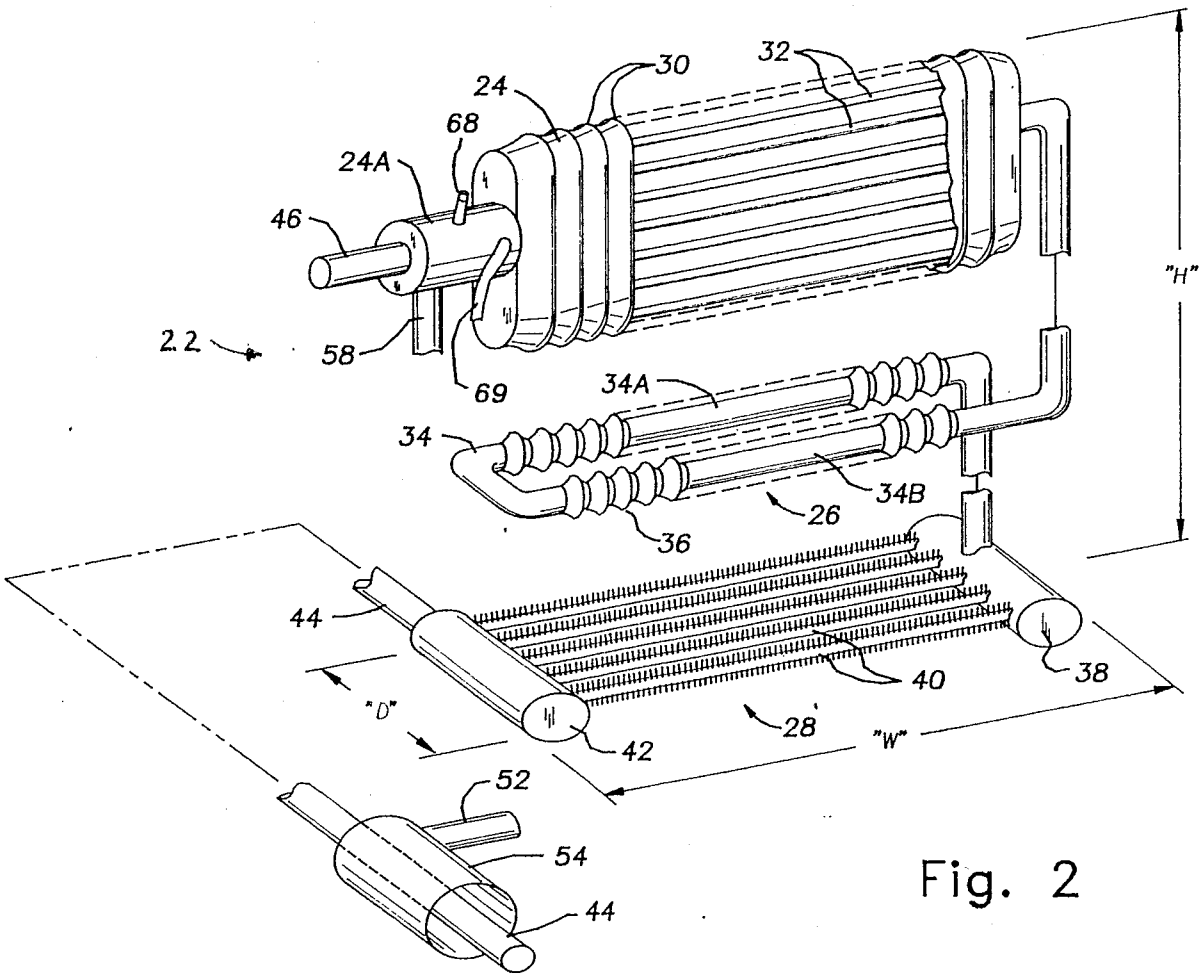
FIG. 2 is a schematic perspective view on an enlarged scale of the burner element assembly used in the space heater shown in FIG. 1 with the spacing between adjacent burner elements being increased for clarity of illustration.

Referring to FIGS. 1 and 2, the mixer head **24*a* and combustion chamber 24 are formed as an integral cast iron structure. The mixer head 24*a* is provided with a 2" cylindrical cross-section and a 3" length. The combustion chamber 24** has a 2"×6" oval cross-section with the major dimension extending in a vertical direction and a 17" length.

The combustion chamber 24 includes integrally formed external fins 30 and internal fins 32. The fins 32 extend along the longitudinal length of the combustion chamber 24. The fins 32 are spaced about 6" to 8" from the upstream end wall of the combustion chamber 24 and about 1" from the downstream end wall thereof. The former spacing of the fins 32 avoids excessive heat transfer adjacent the upstream portions of the combustion chamber and the latter spacing provides smoother flow of the combustion gases into the tailpipe.

The tailpipe 26 is an iron casting including a tubular part 34 having radially extending fins 36. The tubular part 34 has an elongated U-shape with spaced leg portions **34*a* and 34*b* extending horizontally along the width of the heater 10 a distance generally corresponding with the length of the combustion chamber 24. The tubular part 34 has a 1.05" O.D., a 0.8" I.D. and the axes of the leg portions 34*a*, 34*b* are spaced apart 2.575". The fins 36 are of a flattened oval shape with a vertical dimension substantially equal to the O.D. of the tubular part 34 and a horizontal dimension equal to 3.05". Accordingly, the fins 36 extending from the leg portions 34*a* and 34*b* are interleaved and the overall size of the tailpipe 26 is 5.625" as measured from the front-to-back of the heater 10** in the depth direction thereof.

The tailpipe 26 may be formed of stainless steel tubing or black iron pipe (not shown) having wound or welded fin arrangements. If such materials are used, the components may be sized to provide corresponding amounts of heat transfer to the air to be heated as compared with the tailpipe 26.

The secondary heat exchanger 28 includes an intake header 38 connected by a plurality of aluminum finned stainless steel tubes 40 to a discharge header 42. Each of the headers 38 and 42 is formed of a 6" length of stainless steel conduit. Each of the stainless steel tubes 40 is about 17" long and has a 3/8" O.D. Water vapor in the combustion gases is condensed in the heat exchanger 28 and discharged with the combustion gases to the atmosphere through an exhaust outlet 44. In addition to heat recovery, the heat exchanger 28 also tends to muffle and quiet the sound level of the burner operation.

Fuel and air are delivered to the mixer head **24*a* to provide a combustible mixture of gases which is ignited and delivered to the combustion chamber 24. To that end, an air line 46 is arranged to deliver air to the mixer head from an air decoupler 48. The air line 46 extends to a one-way air valve 50 provided in the air decoupler 48. An air supply line 52 extends from the air decoupler 48 to an outside air inlet 54 which is open to the atmosphere for intake of combustion air. A purge blower 56 draws outside air into the decoupler 48. In this manner, a pressurized supply of air is maintained in the decoupler 48 for self-feeding of the air valve 50**.

Fuel gas is delivered to the mixer head **24*a* via gas line 58 and one-way gas flow valve 60. A gas decoupler 62 and gas control valve 64 are also provided. The gas control valve 64 is connected via line 66** to a supply of fuel gas such as natural gas or propane.

For purposes of start-up, an igniter 68 is provided. The purge blower 56 located in the air decoupler 48 also operates during initial start-up and final purging of the burner 20. In order to confirm ignition during operation, a flame sensor 69 is also provided.

The burner 20, and, more particularly, the burner element assembly 22 is substantially enclosed and mounted within an interior housing 70 positioned within the cabinet 12. The volume of the housing 70 is equal to about ⅓ of the volume of the cabinet 12. The upper portion of the housing 70 has a box-like configuration of rectangular cross-section and the lower portion has a wedge-shape.

The housing 70 includes a back wall 72 which may comprise a portion of the rearward wall 14 of the cabinet 12. In either case, the back wall 72 is joined by a peripheral wall 74 to a removable front wall 76. To that end, a flange 78 extends from the wall 74 for engagement with sheet metal screws used to mount the front wall 76. The walls of the housing 70 are formed of a relatively thin gauge material such as 20 gauge sheet metal. The pressurization of the housing 70 during heater operation tends to stress the walls in an outward direction so as to reduce vibration and noise transmission by the housing walls to thereby eliminate the need for wall reinforcements and/or the use of heaver gauge sheet metal.

A conditioned air discharge opening 80 is located in the top peripheral wall 74 of the housing 70. A conditioned air inlet opening 82 is located in a lower peripheral wall 74 of the housing 70. A centrifugal blower 84 is arranged to deliver room air to be conditioned into the housing 70 through air inlet opening 82.

The walls of the housing 70 cooperate to provide a substantially closed heat transfer chamber 86 having inlet and outlet openings 82, 80. The inlet opening 82 comprises a 4.25"×4.75" rectangular opening in the lower peripheral wall 74 which corresponds in size with the outlet of the blower 84. The outlet opening 80 is a 2"×24.25" rectangular opening centrally disposed in the upper portion of the peripheral wall 74.

The burner element assembly 22 is disposed in the chamber 86 as a plurality of stacked element layers which provide a tortuous or obstructed path for the air circulating through the housing 70. The assembly 22 is supported by direct mounting of the combustion chamber to the rear wall 14 of the cabinet and/or the exterior wall of the room in which the heater is used. The tailpipe 26 is supported by its connection to the combustion chamber and the heat exchanger 28 is supported by its connection to the tailpipe. The combustion chamber 24, tailpipe 26 and heat exchanger 28 are thereby rigidly supported by their interconnection in the closely spaced array of assembly 22.

A control box 88 is provided for enclosing conventional thermostatic controls arranged to cause operation of the heater 10 in accordance with sensed temperature conditions. In response to a start up signal, the blower 56 and igniter 68 temporarily operate until combustion is established. Thereafter, the burner 20 operates in a self-sustaining manner as known in the art.

The space heater 10 is arranged to preheat incoming combustion air with the exhausting combustion gases. To that end, the outside air inlet 54 is concentrically disposed about the exhaust outlet 44. In this manner, a further portion of the heat energy of the combustion gases is recovered prior to venting.

Operation of the centrifugal air blower 84 causes ambient air to be heated to be drawn into the cabinet 12 through a louvered opening 90 in the front wall 18. The centrifugal blower 84 directs the air through the inlet opening 82 in an upward flow direction to engage the heat exchanger 28. In the heat exchanger 28, the heat of condensation of the water vapor is recovered together with sensible heat provided by the combustion gases flowing therethrough. The slightly warmer air passes along the surfaces of the heat exchanger 28 into contact with the tailpipe 26 for further heat transfer. Thereafter, the heated air flows along the exterior surfaces of the combustion chamber 24 to complete the heat transfer process. The heated air then passes through the opening 80 in the housing 70 for final discharge into the space to be conditioned through a louvered opening 92 in the top peripheral wall 16 of the cabinet 12.

The end of the heating cycle is signalled by a thermostatic control which operates the gas control valve 64 to a closed position. Thereafter, the purge blower 56 is operated to clear residual combustion products and entrained moisture from the burner 20.

The relative size of the housing 70 and the burner elements 24, 26 and 28 together with the arrangement of the latter to provide the burner element assembly 22 assure effective heat transfer and tend to reduce the sound level of operation of the heater 10. Referring to FIG. 2, the overall depth (D), width (W) and height (H) dimensions are respectively indicated for the burner element assembly 22. As used herein, such overall dimensions designate the minimum size of a rectangular volume or box into which the burner element assembly 22 fits and such volume is the bulk volume of the burner element assembly as mounted in the space heater 10 or heat transfer chamber 80.

The overall dimensions of the burner element assembly 22 are 22.75" (W)×11" (H)×6" (D) and it has a corresponding bulk volume of about 1502 in.$^3$ as mounted in the heater 10. In the illustrated embodiment, the housing 70 is 24.25" wide, 6.25" deep, 14" high on the left side, 12" high on the right side, and 17.25" high at the wedge bottom which is spaced 5" from the right side of the housing. Accordingly, the heat transfer chamber 80 as defined by the interior housing 70 has a volume of about 3133 in.$^3$ including the wedge shape lower portion. The ratio of the bulk volume of the assembly 22 to the volume of the heat transfer chamber 80 is 0.48 or about 0.5. By rearrangement of the vertical spacing of the burner elements 24, 26 and 28, the height of the assembly 22 may be reduced to about 9.5". Such an arrangement results in a bulk assembly volume of about 1297 in.$^3$ and an assembly to chamber ratio of 0.41 or about 0.4. Accordingly, the bulk volume of the assembly 22 is equal to from about 40% to about 50% of the volume of the chamber 80 as defined by the housing 70.

In accordance with the foregoing size arrangements, the interior housing 70 is pressurized to about 0.1 to 0.3 in. W.C. at air flows therethrough in the range of about 180 to 240 CFM. The pressurization and degree of heat transfer are related to the central positioning of the burner element assembly 22 in the housing 70 since both elimination of localized sites of significantly different temperature and extensive contact with the heat transfer surfaces of the burner elements are achieved thereby accordingly, the width of the assembly 22 should be as close to that of the housing 70 as possible with allowance for reasonable manufacturing and assembly clearances. Herein, a ¼" clearance is used. It is advantageous to orient the combustion chamber 24 with the major dimension in the vertical in order to maximize contact with the flowing air as it is streamlined for discharge through the narrow outlet opening 80 in the housing 70.

The steady state thermal efficiency, based on the flue loss measured at the outlet of the secondary heat exchanger 28 is about 90%. The percent of the total heat transferred by each burner element, based on flue gas temperatures at the exit of each element, is about 71% for the combustion chamber, 15% for the tailpipe and 4% for the secondary heat exchanger. The relatively high degree of heat transfer achieved in pulse combustion systems is related to the high velocity of the combustion gases which results in an effective scrubbing of the heat transfer surfaces and elimination of film layers.

At a distance of about 3 feet, the sound pressure level of the heater 10 is about 53 dBA. This is achieved in part by pressurization of the interior housing 70 to minimize vibration of the housing walls.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A pulse combustion space heater for heating air in a space to be temperature conditioned including a cabinet having exterior walls providing a cabinet volume for enclosing and supporting the heater, interior housing means located within said cabinet volume including walls providing a substantially closed heat transfer chamber having inlet and outlet openings through which air to be heated is circulated and a chamber volume substantially smaller than said cabinet volume, pulse combustion burner means including an assembly of closely spaced elongate burner elements operably connected in a fluid-tight manner for pulse combustion of a combustible gaseous mixture and discharge of combustion products to the atmosphere, said burner elements having exterior heat transfer surfaces located within said heat transfer chamber for transfer of combustion heat to air contacting the heat transfer surfaces, and blower means for circulating air from said space through said heat transfer chamber for heating by contact with said burner element assembly and then back into said space said burner element assembly having a bulk volume equal to at least about 40% of the volume of said heat transfer chamber and said blower means pressurizing said heat transfer chamber to a pressure in the range of from about 0.1 to about 0.3" W.C. to substantially eliminate localized sites of significantly different temperature in the heat transfer chamber and to reduce the tendency of said interior housing means walls to vibrate.

2. A heater according to claim 1, wherein said interior housing means and said burner element assembly cooperate to provide a tortuous path for air passing through said heat transfer chamber.

3. A heater according to claim 2, wherein said interior housing means and said burner element assembly are arranged to provide substantially countercurrent heat transfer with the air passing through said heat transfer chamber sequentially engaging heater elements of increasing operating temperature.

4. A heater according to claim 3, wherein said burner element assembly has a bulk volume equal to from about 40% to about 50% of the heat transfer chamber volume.

5. A heater according to claim 4, wherein said burner element assembly includes a combustion chamber, a tailpipe and a condensing heat exchanger disposed in a stacked arrangement.

6. A heater according to claim 5, wherein said condensing heat exchanger condenses water vapor in said combustion products to recover the heat of condensation of condensate, and muffles the noise level of the space heater.

7. A heater according to claim 5, wherein said blower means is arranged to circulate air through said heat transfer chamber at a flow rate in the range of from about 180 to about 240 CFM.

8. A heater according to claim 5, wherein said tailpipe is supported solely by connection to said combustion chamber and said heat exchanger is supported solely by connection to said tailpipe.

9. A heater according to claim 8, wherein said heater has dimensions extending in width, depth and height directions, and said burner element assembly has an overall depth substantially corresponding with the depth of said heat transfer chamber.

10. A heater according to claim 9, wherein said tailpipe and said condensing heat exchanger each include a plurality of finned tubular members arranged in a horizontally extending array having a depth dimension substantially equal to that of said heat transfer chamber.

* * * * *